US007627927B2

(12) United States Patent
Blocker et al.

(10) Patent No.: US 7,627,927 B2
(45) Date of Patent: Dec. 8, 2009

(54) VACUUM CLEANER WITH SENSING SYSTEM

(75) Inventors: Douglas L. Blocker, Festus, MO (US); John F. Kaido, Arnold, MO (US); T. Joy H. Petty, St. Louis, MO (US)

(73) Assignee: Tacony Corporation, Fenton, MO (US)

( * ) Notice: Subject to any disclaimer, the term of this patent is extended or adjusted under 35 U.S.C. 154(b) by 70 days.

(21) Appl. No.: 11/760,077

(22) Filed: Jun. 8, 2007

(65) Prior Publication Data

US 2008/0301899 A1 Dec. 11, 2008

(51) Int. Cl.
*A47L 9/30* (2006.01)

(52) U.S. Cl. ..... 15/324; 15/319; 15/339

(58) Field of Classification Search ..... 15/319, 15/324, 339; *A47L 9/30*
See application file for complete search history.

(56) References Cited

U.S. PATENT DOCUMENTS

| | | | | |
|---|---|---|---|---|
| 2,625,239 | A | | 1/1953 | Senne |
| 2,715,452 | A | | 8/1955 | Kent |
| 3,226,758 | A | * | 1/1966 | Brown et al. ..... 15/327.1 |
| 3,232,030 | A | | 2/1966 | Owenmark |
| 3,510,904 | A | | 5/1970 | Lagerstrom |
| 3,679,885 | A | | 7/1972 | Selley |
| 3,936,904 | A | | 2/1976 | Bashark |
| 3,984,735 | A | | 10/1976 | Schwartz |
| 4,034,415 | A | | 7/1977 | Suer |
| 4,083,001 | A | | 4/1978 | Paice |
| 4,099,861 | A | | 7/1978 | Abel |
| 4,195,254 | A | | 3/1980 | Gurwicz et al. |
| 4,342,132 | A | | 8/1982 | Fromknecht |
| 4,601,082 | A | | 7/1986 | Kurz |
| 4,654,924 | A | | 4/1987 | Getz et al. |
| 4,767,213 | A | | 8/1988 | Hummel |
| 4,937,912 | A | | 7/1990 | Kurz |
| 4,977,639 | A | | 12/1990 | Takahashi et al. |
| 5,014,388 | A | | 5/1991 | Schiazza et al. |
| 5,023,973 | A | | 6/1991 | Tsuchida |
| 5,105,502 | A | | 4/1992 | Takashima |
| 5,107,565 | A | | 4/1992 | Chun |
| 5,136,750 | A | | 8/1992 | Takashima |
| 5,243,732 | A | | 9/1993 | Koharagi et al. |
| 5,301,385 | A | * | 4/1994 | Abe et al. ..... 15/319 |
| 5,373,598 | A | | 12/1994 | Weber |
| 5,551,119 | A | | 9/1996 | Wörwag |
| 5,561,346 | A | | 10/1996 | Byrne |
| 5,608,944 | A | | 3/1997 | Gordon |

(Continued)

FOREIGN PATENT DOCUMENTS

| | | |
|---|---|---|
| EP | 0530026 | 3/1993 |

(Continued)

*Primary Examiner*—David A Redding
(74) *Attorney, Agent, or Firm*—Christopher R. Carroll; Dean D. Small; Small Patent Law Group

(57) ABSTRACT

A vacuum cleaner having a floor nozzle movable by a user of the vacuum cleaner over a floor to suction dirt from the floor. A sensing system is provided for sensing a condition relating to the vacuum cleaner and for generating a signal in response to the condition. A sensor-responsive light system on the floor nozzle is responsive to the signal for projecting light onto the floor for observance by the user.

20 Claims, 13 Drawing Sheets

U.S. PATENT DOCUMENTS

| | | | | |
|---|---|---|---|---|
| 5,815,884 | A | 10/1998 | Imamura | |
| 5,819,367 | A * | 10/1998 | Imamura | 15/339 |
| 5,987,697 | A | 11/1999 | Song | |
| 6,256,833 | B1 | 7/2001 | Steinberg | |
| 6,389,329 | B1 | 5/2002 | Colens | |
| 6,490,755 | B2 | 12/2002 | Paterson | |
| 6,672,735 | B2 | 1/2004 | Dilger | |
| 7,328,479 | B2 * | 2/2008 | Willenbring | 15/324 |
| 2002/0101730 | A1 | 8/2002 | Dilger | |
| 2004/0163200 | A1 | 8/2004 | Overvaag | |
| 2005/0273968 | A1 | 12/2005 | Seith | |
| 2006/0075597 | A1 | 4/2006 | Overvaag | |
| 2006/0096057 | A1 | 5/2006 | Chatfield | |
| 2007/0180648 | A1 * | 8/2007 | Andrup et al. | 15/339 |

FOREIGN PATENT DOCUMENTS

| | | | |
|---|---|---|---|
| EP | 0530026 | A1 | 3/1993 |
| JP | 4189335 | | 7/1992 |
| JP | 5049576 | | 3/1993 |

* cited by examiner

VACUUM CLEANER WITH SENSING SYSTEM

BACKGROUND OF THE INVENTION

This invention relates generally to vacuum cleaners, and more particularly to a vacuum cleaner equipped with a system for sensing and signaling a condition relating to the vacuum cleaner (e.g., the presence of dirt on the surface being cleaned or the need to change a filter).

In conventional vacuum cleaners, it is known to provide lights on the suction head ("floor nozzle") of the vacuum to illuminate the area in front of the vacuum. Further, some cleaners are equipped with a dirt sensor and a small indicator lamp or lamps on the floor nozzle, body or handle of the vacuum which illuminate when dirt is sensed. To view the lamp(s), the operator must look to that spot on the vacuum to determine if the dirt sensor has sensed the presence of dirt. These indicator lamps do not project a beam onto the surface being cleaned; they simply go on and off and the person using the cleaner must look at the lamp itself to determine whether it is on or off.

There is a need therefore for an improved sensing system which provides a readily visible signal when a condition is sensed.

SUMMARY OF THE INVENTION

In general, a vacuum cleaner of one embodiment of this invention comprises a floor nozzle movable by a user of the vacuum cleaner over a floor to suction dirt from the floor, a sensing system for sensing a condition relating to the vacuum cleaner and for generating a signal in response to said condition, and a sensor-responsive light system on the floor nozzle responsive to the signal for projecting light onto the floor for observance by said user.

In a second embodiment, a vacuum cleaner of this invention comprises a floor nozzle movable by a user of the vacuum cleaner over a floor to suction dirt from the floor. An illumination system on the floor nozzle projects illuminating light in a forward direction onto the floor to illuminate a working area of the floor over which the floor nozzle is moved. A dirt-sensing system senses dirt suctioned into the vacuum cleaner and generates a signal in response to either the presence or absence of dirt. A sensor-responsive light system on the floor nozzle, separate from said illumination system, is responsive to the signal for projecting light onto the floor for observance by the user.

Other objects will become in part apparent and in part pointed out hereinafter.

BRIEF DESCRIPTION OF THE DRAWINGS

Corresponding reference numbers indicate corresponding parts throughout the drawings.

DETAILED DESCRIPTION

Figure 1:
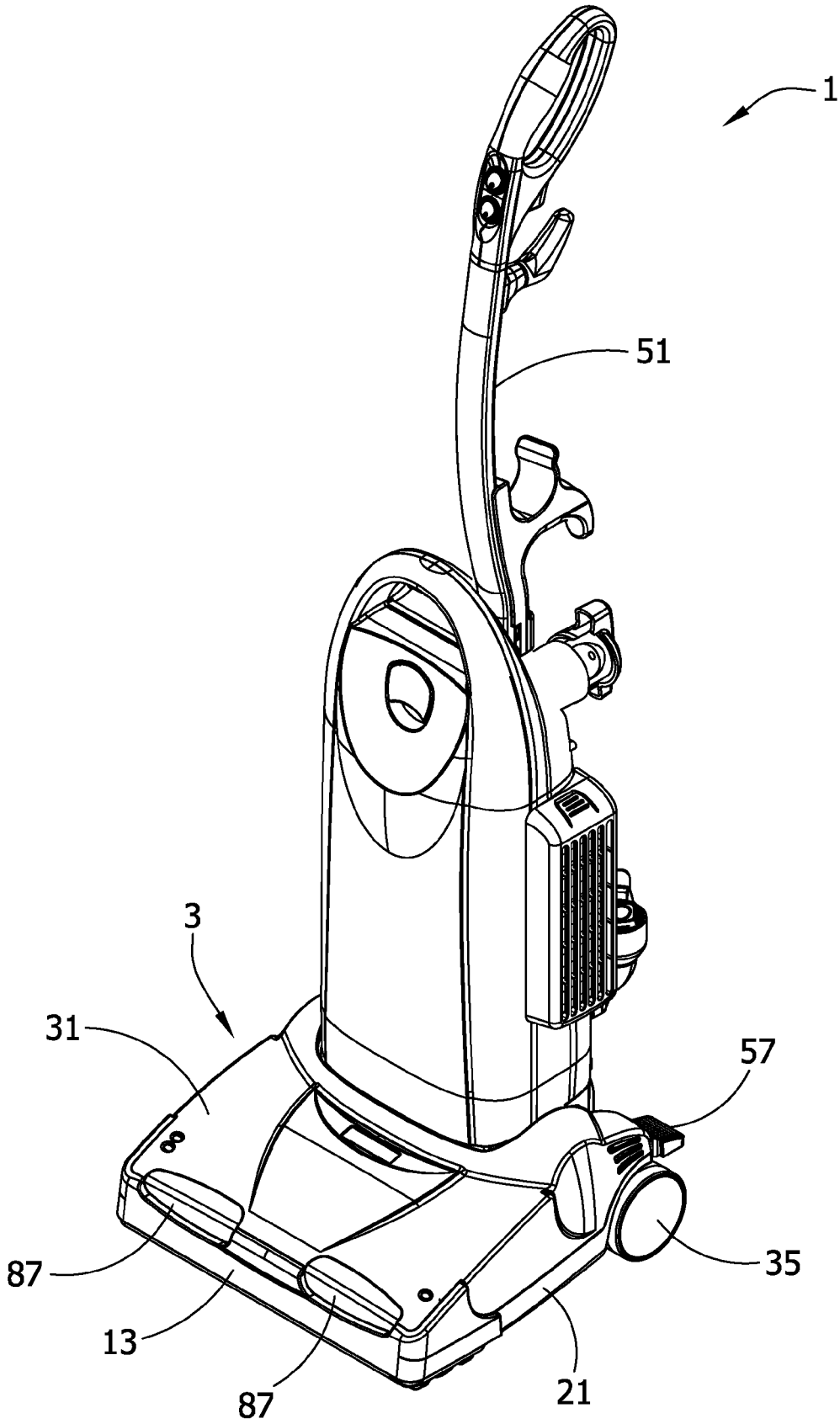
FIG. 1 is a perspective of one embodiment of a vacuum cleaner incorporating a sensing system of this invention.

Referring now to the drawings, and first more particularly to FIGS. 1-4, one embodiment of a vacuum cleaner of this invention is indicated in its entirety by the reference numeral 1. In this embodiment, the vacuum cleaner is an upright vacuum cleaner, but it will be understood that this invention is also applicable to canister vacuum cleaners and other types of cleaners. In general, the vacuum cleaner comprises a floor nozzle, generally designated 3, movable by a user over a floor to suction dirt from the floor. The nozzle is equipped to sweep dirt from the floor up into nozzle for delivery to a waste bag or other collection device. A sensing system, generally designated 5 (FIG. 4), is provided on the nozzle 3 for sensing a condition relating to the vacuum cleaner and for generating a signal in response to that condition. The condition may be the presence of dirt, for example, but other conditions are contemplated (e.g., whether a filter or dirt receptacle needs to be replaced). The cleaner 1 also includes a sensor-responsive light system 7 (FIG. 3) on the floor nozzle responsive to the generated signal for projecting light in a forward direction onto the floor F (FIG. 10) where it may readily be observed by the user. In addition, the cleaner of this particular embodiment also includes an illumination system 9 (FIG. 3) on the floor nozzle 3 for projecting illuminating light in a forward direction onto the floor to illuminate a working area of the floor over which the floor nozzle is moved. The relevant components of the cleaner 1 are described in more detail below.

Figure 2:
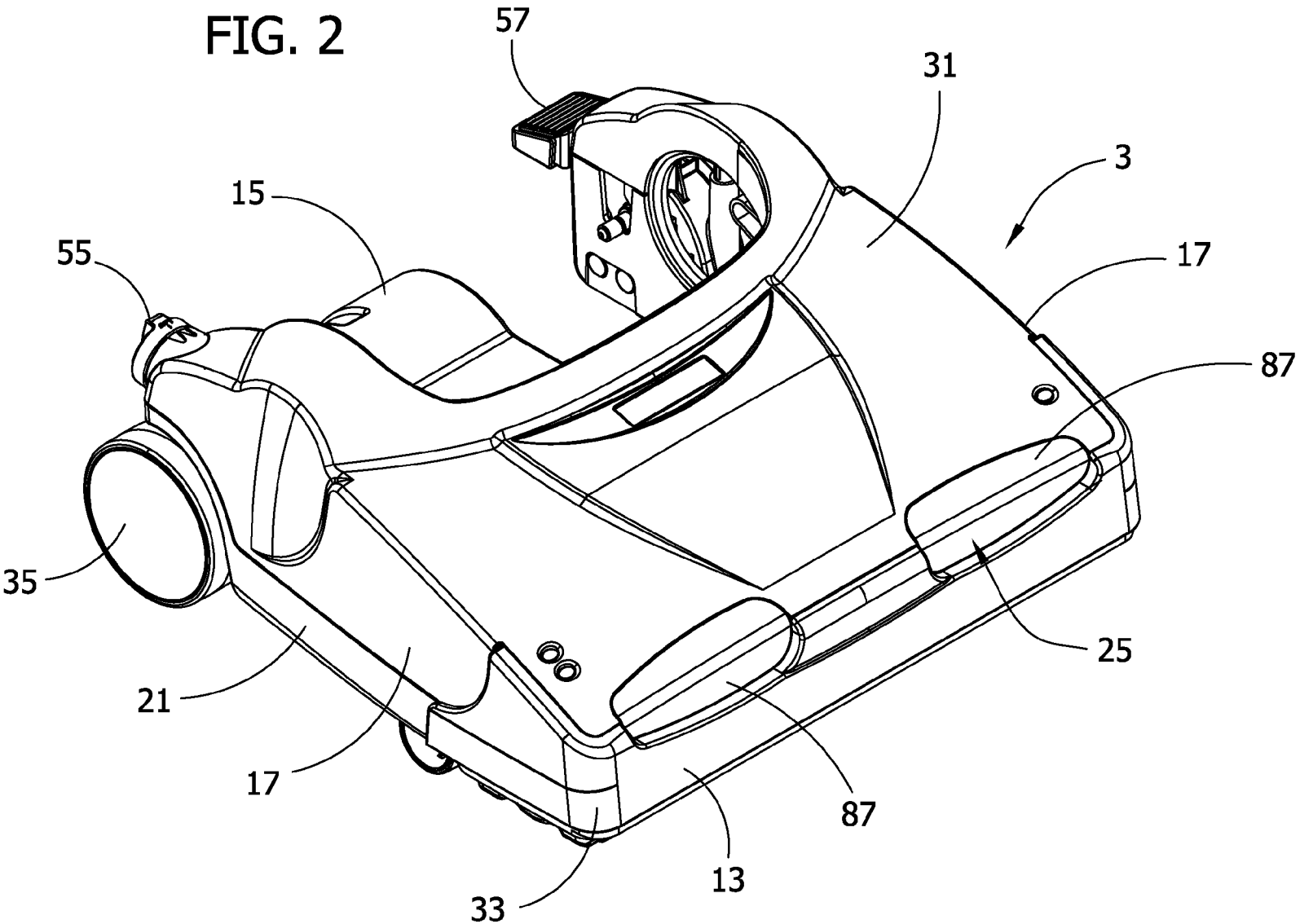
FIG. 2 is a front perspective of a floor nozzle of the cleaner of FIG. 1.
Figure 3:
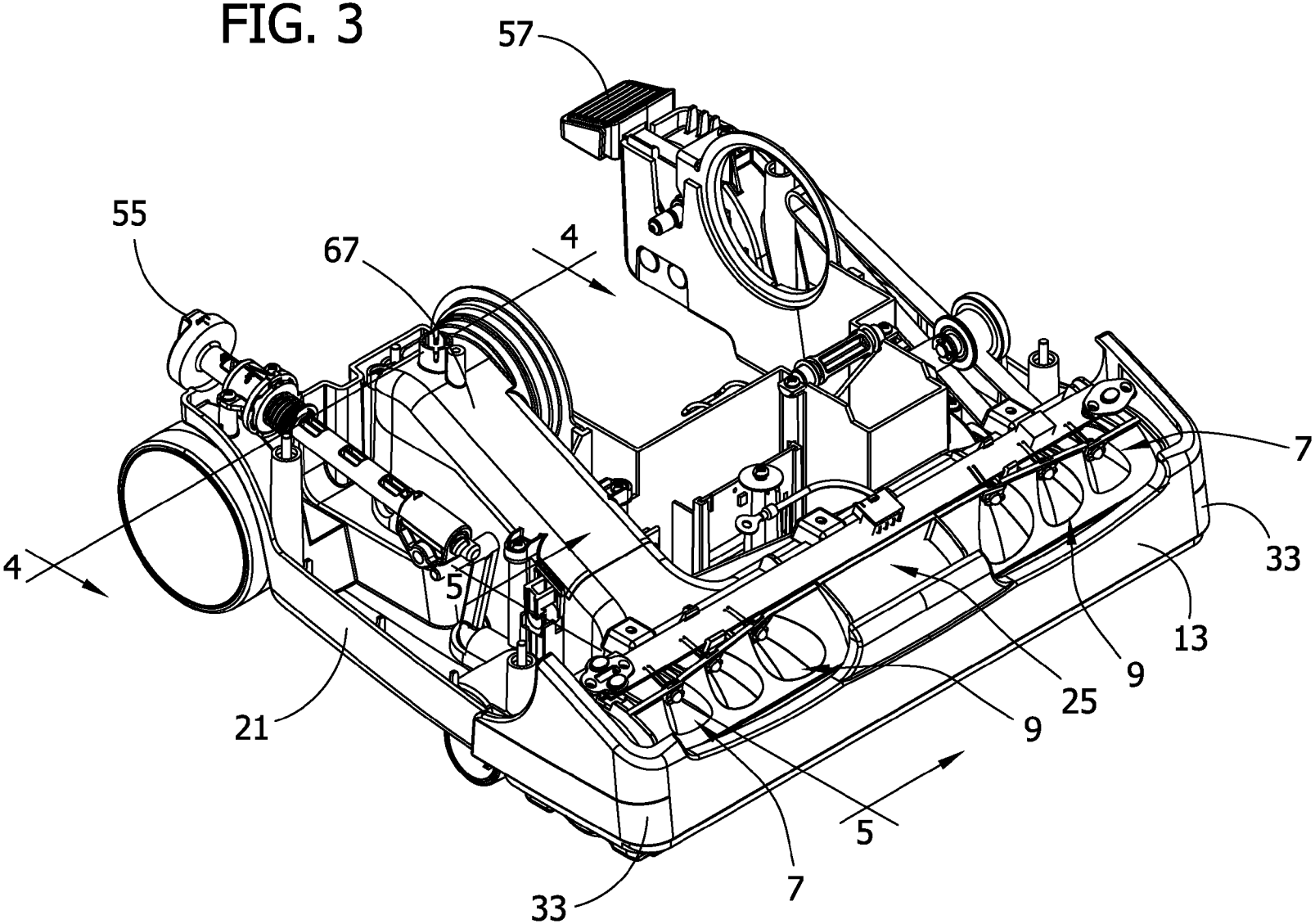
FIG. 3 is a view similar to FIG. 2 but with a cover of the nozzle removed to show a sensor-responsive light system and an illumination system of the cleaner.
Figure 4:
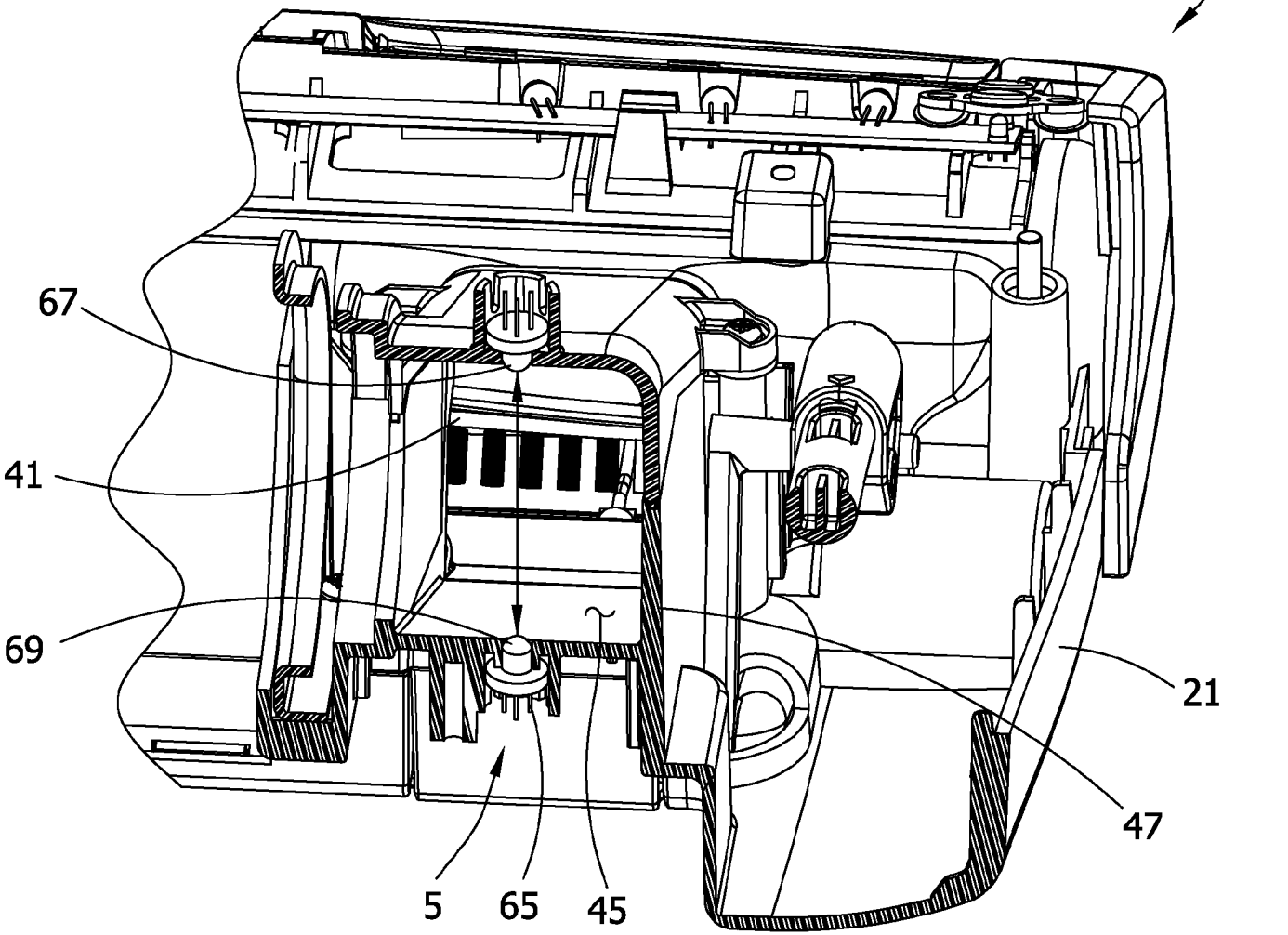
FIG. 4 is a rear perspective of FIG. 3 with parts shown in section to show a sensing system of the cleaner.
Figure 5:
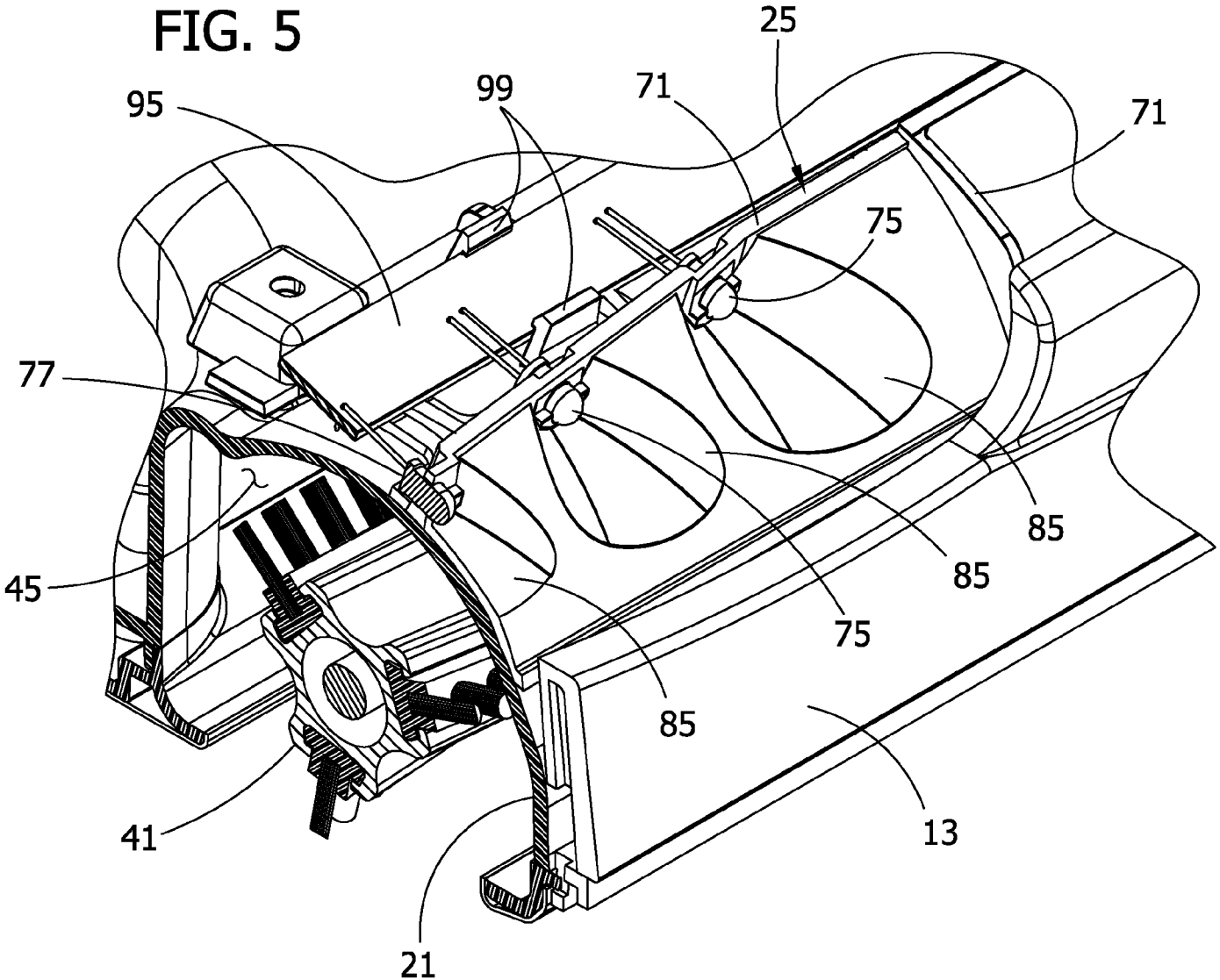
FIG. 5 is an enlarged portion of FIG. 3 with parts shown in section to show an agitator and a suction flow passage to the rear of the agitator.

Referring to FIGS. 2 and 5, the floor nozzle 3 has a front 13, back 15, and opposite sides 17. The nozzle 3 comprises a base tray 21, a removable cover 31 on the base tray, a front bumper 33 attached to the base tray, and wheels 35 on the base tray at the back of the base tray. An agitator 41 (e.g., a power brush roll in FIG. 5) is mounted on the base tray 21 and rotates about a generally horizontal axis extending side-to-side with respect to the nozzle 3 to sweep dirt from the floor up along an air flow path 45 defined in part by a housing 47 on the base tray for delivery to a collection device. An upright handle 51 (FIG. 1) is pivoted at its lower end to the base tray 21 for use by an operator to move the nozzle along the floor. Other features are also shown, including a height adjustment mechanism 55 and a tilt lock pedal 57.

Figure 12:
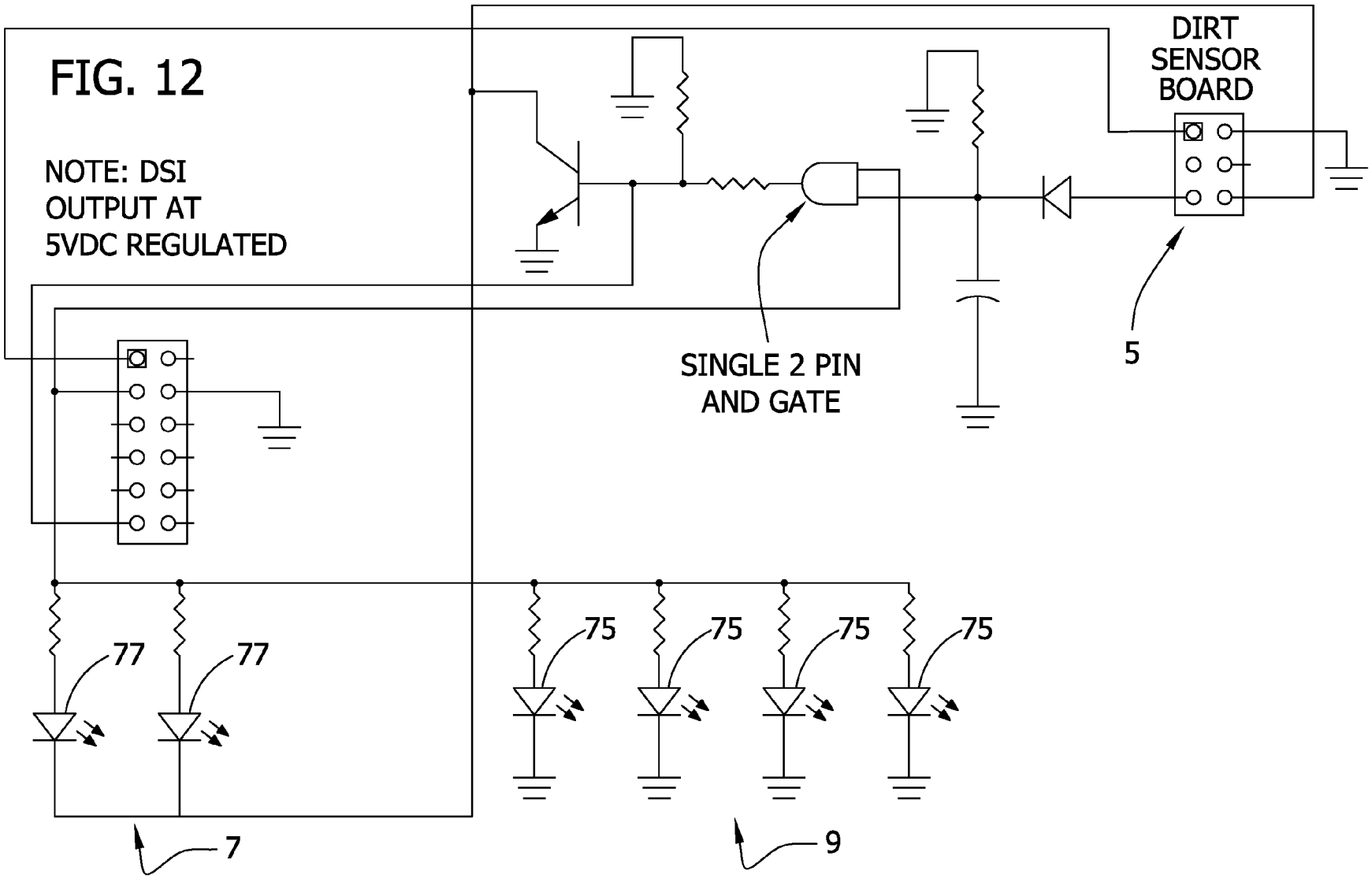
FIG. 12 is an exemplary electrical circuit of the sensing system, sensor-responsive light system and illumination system of the cleaner.

In one embodiment, the sensing system 5 comprises a dirt sensor 65 (FIG. 4) positioned adjacent the air flow path 45 for sensing the passage of dirt into the vacuum cleaner. The sensor 65 may be of any suitable type, such as a sensor comprising a light emitter 67 and receptor 69 mounted on the housing 47 of the base tray 21 on opposite sides of the air flow path 45, the arrangement being such that a significant amount of dirt in the air flow path will interfere with the beam as sensed by the receptor to signal the presence of dirt. A suitable sensor of this type is commercially available from Kurz Industrie-Elektronik GmbH in Remshalden Germany. A related sensing system is described in U.S. Pat. No. 4,601,082. An exemplary electrical circuit for the sensing system is shown in FIG. 12.

The sensing system 5 may also be adapted for sensing conditions other than the presence of dirt. By way of example, the sensing system may comprise a sensor for sensing an air flow characteristic (e.g., volume or rate) through a filter to signal when the filter needs to be replaced, or the sensing system may comprise a sensor for sensing the level of dirt in a dirt collector (e.g., bag) on the cleaner 1 to signal when the collector needs to be replaced.

In the preferred embodiment, the sensor-responsive light system 7 and the illumination system 9 comprise a series of lights mounted in a frame 71 on the base tray 21 of the nozzle 3 adjacent the front 13 of the nozzle. The lights are preferably LED devices, e.g., ultra-bright LED devices of the type commercially available from Genertec International Corporation of Beijing, China under the designation 503SYC3F-11E. For convenience, a light of the illumination system 9 is hereinafter referred to as an "illumination LED device", designated 75, and a light of the sensor-responsive light system is referred to as "sensor-responsive LED device", designated 77.

Figure 6:
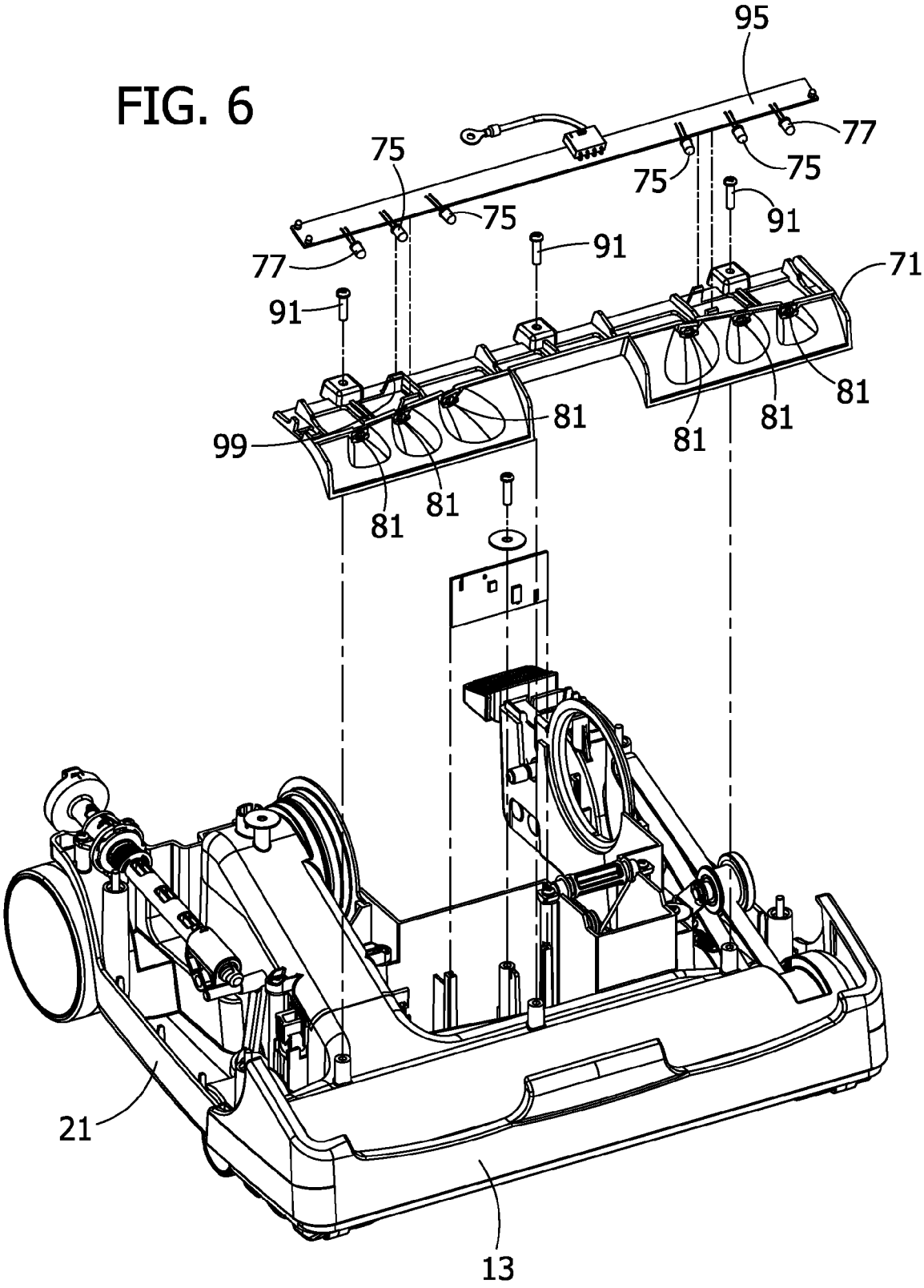
FIG. 6 is a view similar to FIG. 3 but with parts of the sensor-responsive light system and the illumination system exploded away from the nozzle.
Figure 7:
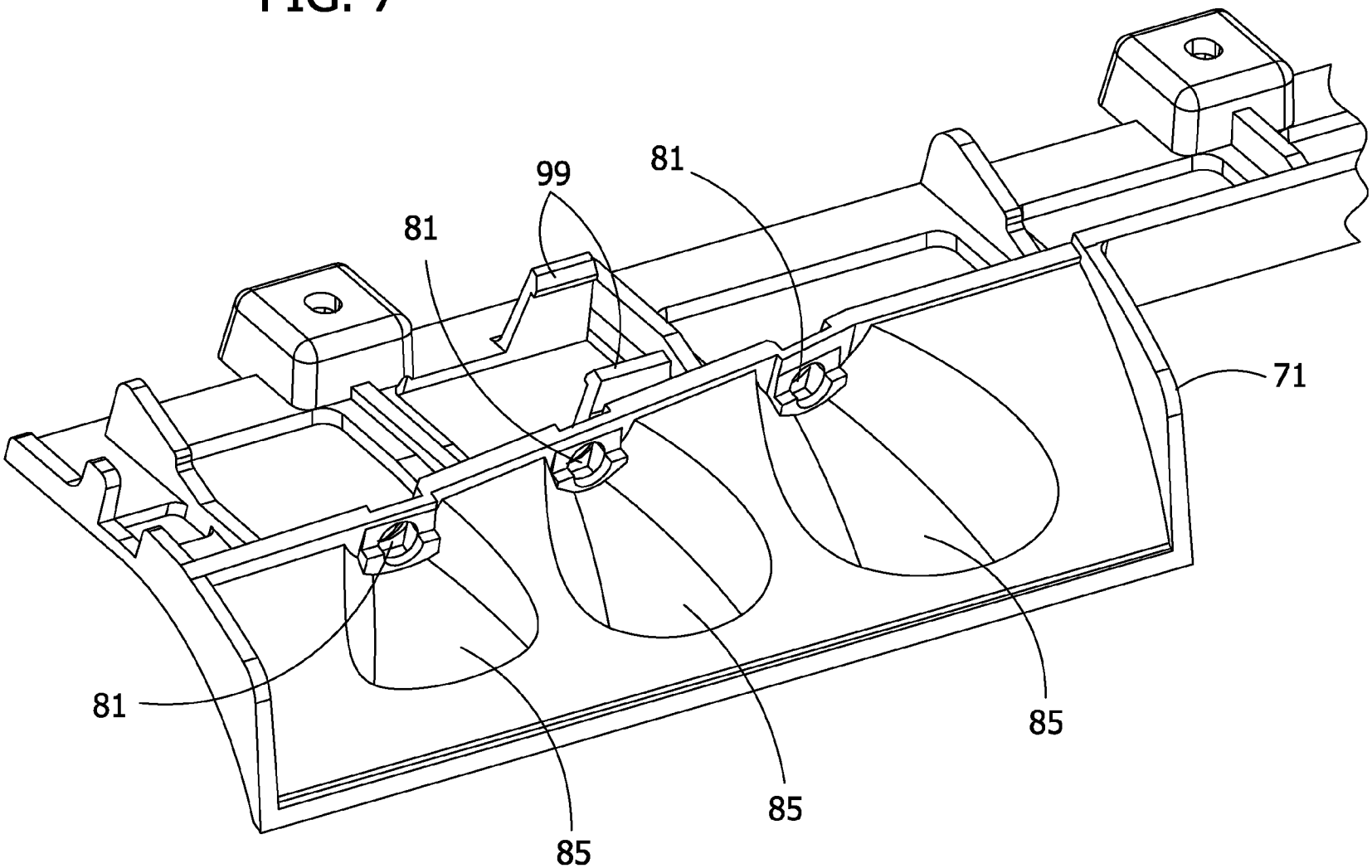
FIG. 7 is an enlarged perspective of a portion of a frame for holding LED devices of the sensor-responsive light system and the illumination system.

Referring to FIGS. 6 and 7, the frame 71 has openings defining sockets 81 which receive respective LED devices 75, 77 such that the devices are positioned to project light beams in a generally forward and downward angled direction to illuminate an area on the floor in front of the cleaner 1. The frame 71 has contoured surfaces positioned forward of the sockets to form reflectors 85 which assist in providing the desired light pattern. One or more lenses 87 (FIG. 2) are mounted on the frame 71 in front of the LED devices 75, 77 and reflectors 85. The lenses 87, frame 71, base tray 21 and cover 31 enclose the LED devices 75, 77. The LED devices 75, 77 are removable from respective sockets 81 for replacement as needed. To ensure that the light emitted by the sensor-responsive LED device(s) 77 is readily visible upon activation, the light is of a different color than the light emitted by the LED devices 75 of the illumination system 9. By way of example, the light generated by illumination system 9 is of a first color, e.g., a generally white light, and the light generated by the sensor-responsive light system 7 is of a second color, e.g., one of red, green or yellow.

FIG. 6 is an exploded view of the base tray 21, frame 71 and LED devices 75, 77 of the sensor-responsive light system 7 and the illumination system 9. As shown, the frame 71 is secured to the base tray 21 by fasteners 91 for easy removal. The LED devices 75, 77 are mounted on a printed circuit board 95 attached to the frame 71. In this embodiment, the PC board 95 is snap-fastened to the frame 71 by two sets of resilient spring clips 99, each set comprising opposing front and back clips (see FIGS. 5-7). To mount the board 95 on the frame 71, the front of the board is tilted down to insert the LED devices 75, 77 in their respective sockets 81 and to position the front edge of the board under the front clips 99. The back of the board 95 is then pivoted down to snap the back edge of the board under the rear clips 99 to secure the board and LED devices in place. Other mounting systems may be used.

The frame 71 and its sockets 81 are configured for mounting the LED devices 75, 77 at the appropriate angles to provide the desired light pattern. Specific examples of these angles are described below. In general, however, the LED devices 75, 77 are preferably held in an orientation such that the central axis 105 of the conical light beam emitted by each device is at a desired yaw angle "A", as viewed from above the cleaner (FIG. 9), with respect to a horizontal axis 107 extending in front-to-back direction relative to the cleaner (i.e., parallel to the longitudinal centerline 109 of the cleaner), and at a desired pitch angle "B", as viewed from the side of the cleaner (FIG. 10), relative to a vertical axis 115.

Figure 8:
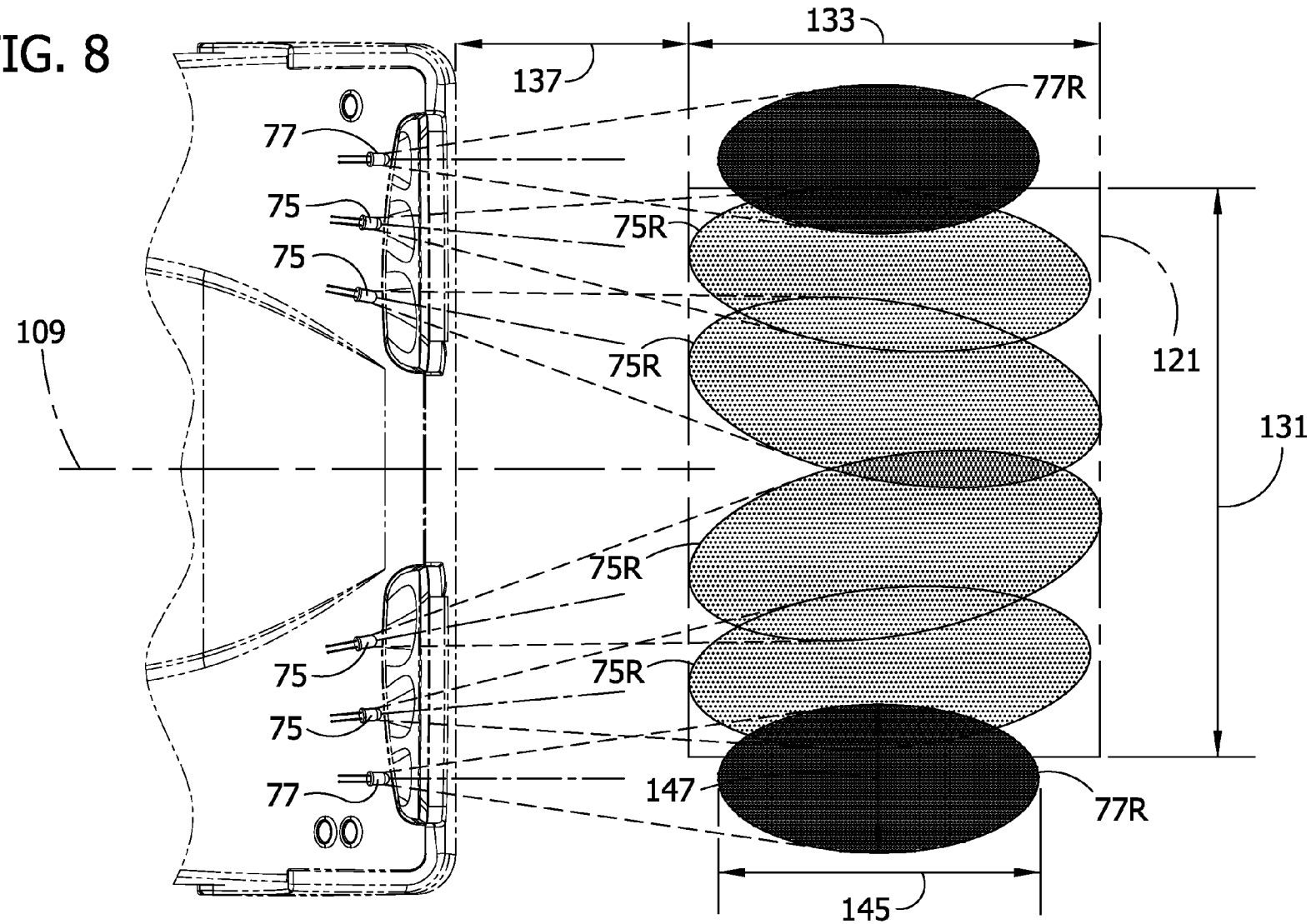
FIG. 8 is a top plan schematic view of the cleaner showing an exemplary light pattern emitted by the LED devices.
Figure 9:
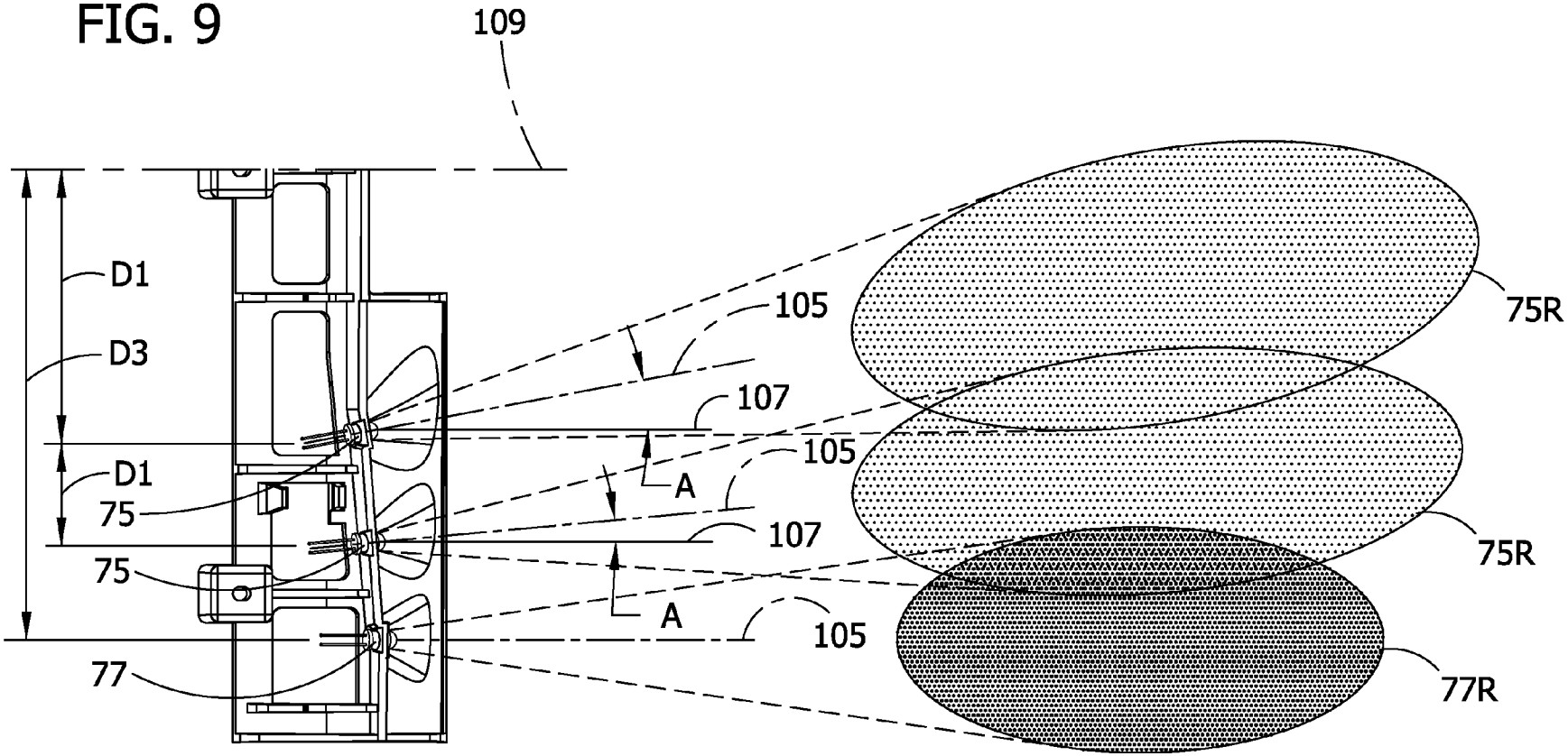
FIG. 9 is an enlarged portion of FIG. 8 showing one-half of the light pattern, the other one-half being symmetrical with respect to the centerline of the cleaner.

The cleaner shown in FIGS. 6-9 is equipped with four illumination LED devices 75 and two sensor-responsive LED devices 77, each of which illuminates an oval-shaped region on the floor. In FIGS. 8 and 9, the regions illuminated by the LED devices 75 are designated 75R and the regions illustrated by the LED devices 77 are designated 77R. (The number of LED devices 75, 77 and the shapes of the illuminated regions may vary.) The LED devices 75, 77 are mounted in a substantially linear arrangement extending side-to-side across the nozzle 3 toward and generally adjacent the front 13 of the nozzle, with two of the four illumination LED devices 75 being mounted on each side of the central longitudinal axis 109 of the cleaner. The two inboard illumination LED devices 75 are spaced a distance D1 from this axis (FIG. 9), and the two outboard illumination LED devices are spaced from respective inboard devices by a distance D2. By way of example, distance D1 may be about two to three in. (e.g., 2.9 in.) and distance D2 may be about one to two in. (e.g., 1.2 in.). Each of the two inboard illumination LED devices 75 generates a conical beam having an angle of divergence of about 20 to 30 degrees (e.g., about 25 degrees), and the central axis 105 of the beam is angled inward toward the central longitudinal axis 109 of the machine at a yaw angle A of about 10 degrees (FIG. 9). Further, the beam is angled downward at a pitch angle B of about 15 to 25 degrees (e.g., about 20 degrees; see FIG. 10). On the other hand, each of the two outboard illumination LED devices 75 generates a conical beam having an angle of divergence of about 20 to 30 degrees (e.g., about 25 degrees), and the central axis 105 of the beam is angled inward toward the central longitudinal axis 109 of the machine at a yaw angle A of about 5 degrees. Further, the beam is angled downward at a pitch angle B of about 15 to 25 degrees (e.g., about 20 degrees). As thus configured and arranged, the regions of light 75R projected onto the floor overlap to substantially entirely illuminate an area 121 (FIG. 8) disposed forward of and generally centrally with respect to the cleaner 3. The size of this central area 121 and its specific location relative to the floor nozzle 3 will vary, but in general it should be in the line-of-sight 125 of a person of average height (5.0 feet or taller) using the cleaner (see FIG. 11). It should also be sized such that it is readily visible while looking at the floor to be cleaned. By way of example but not limitation, the area 121 may be generally rectangular in shape (see FIG. 8) and have a side-to-side dimension 131 in the range of about nine to ten in., a front to back dimension 133 in the range of about six to seven in., and a spacing 137 from the front of the nozzle body in the range of about three to four in. Of course, these dimensions may be varied by changing type of LED device 75 used, the spacing between the LED devices 75, the pitch and yaw angles at which the LED devices are mounted, and/or other factors readily apparent to those skilled in the art. In general, however, the area of illumination 121 should be spaced a sufficient distance forward of the nozzle that it is readily visible by an operator of the cleaner. By way of example but not limitation, in this embodiment, the light area 121 starts at a distance of about three to four in. from the front 13 of the cleaner 1 and ends at a distance of about 10 to 11 in. from the front of the cleaner.

Figure 10:
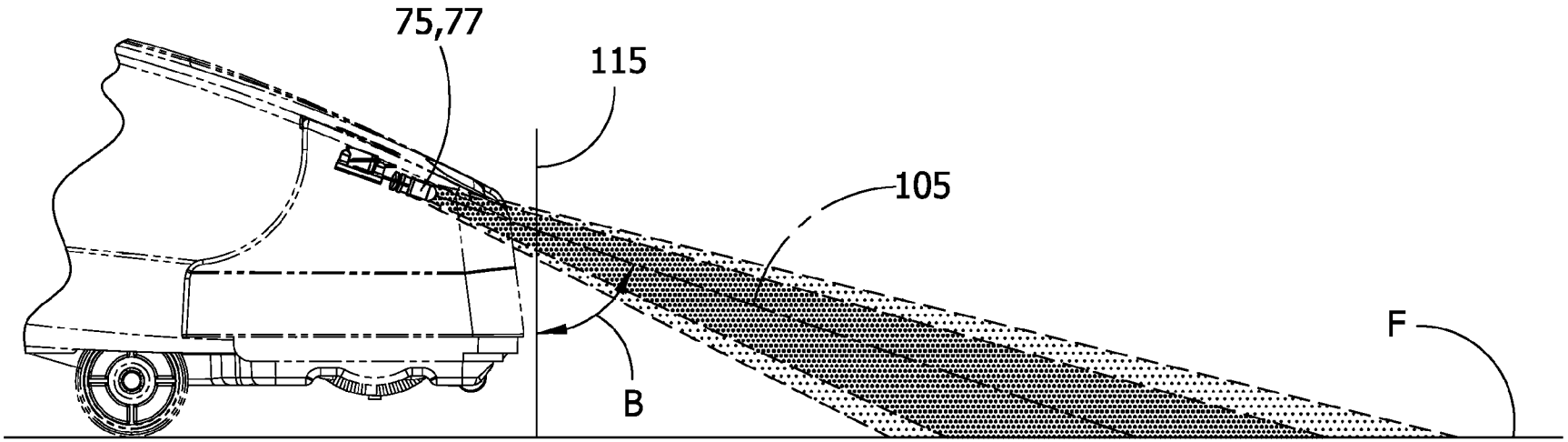
FIG. 10 is a schematic side elevation of the cleaner showing the pitch angles of the light beams emitted by the light systems.
Figure 11:
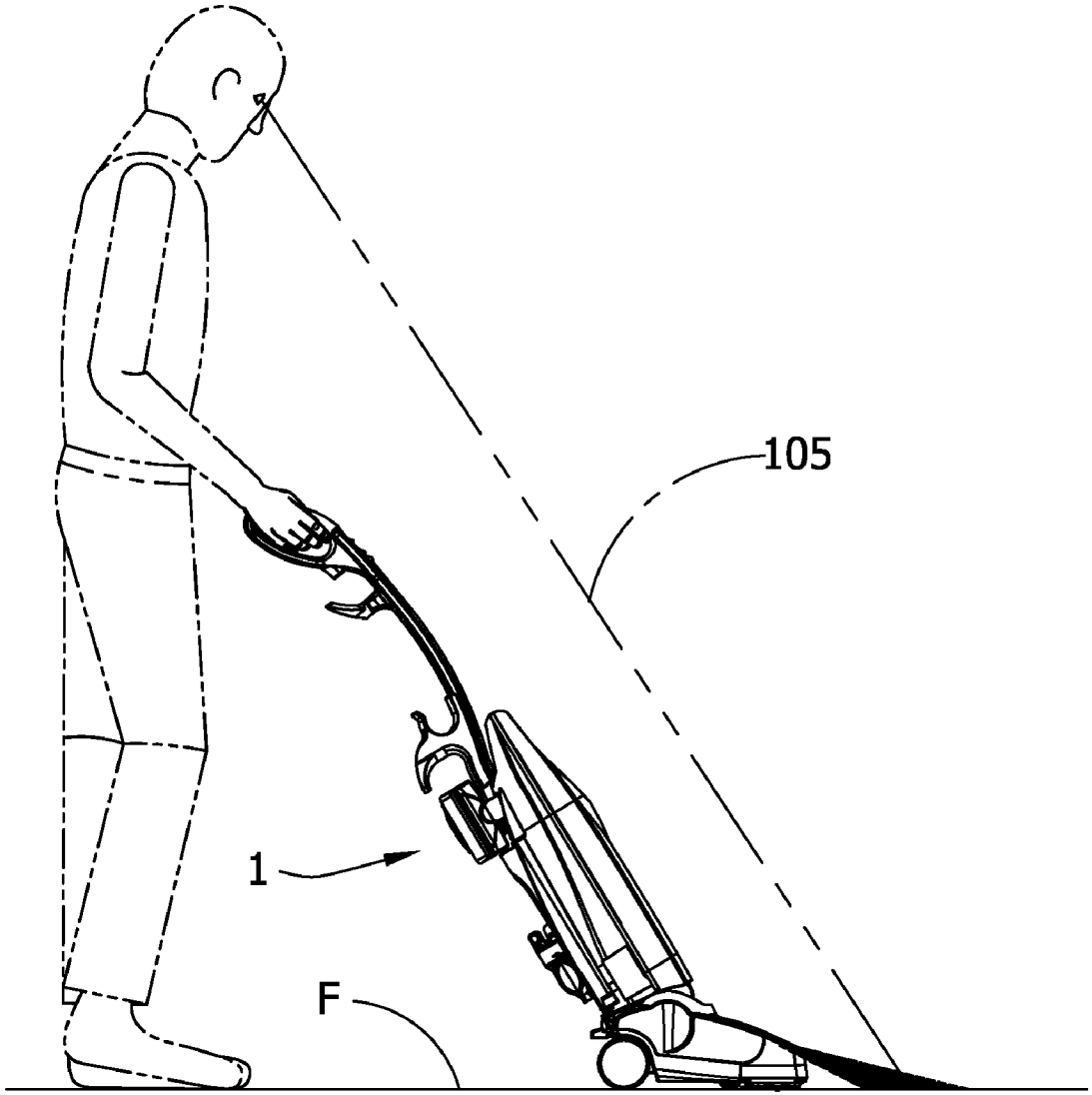
FIG. 11 is a side elevation showing the line of sight of a person operating the cleaner.

In the embodiment of FIGS. 8-10, the two sensor-responsive LED devices 77 are mounted outboard of the illumination LED devices 75 toward opposite sides 17 of the nozzle 3. Each sensor-responsive LED device 77 is spaced a distance D3 (FIG. 9) from the central longitudinal axis 109 of the cleaner. By way of example, distance D3 may be about 4.5 to 5.5 in. Each of the two sensor-responsive LED devices 77 generates a conical beam having a conical angle of divergence of about 20 to 30 degrees (e.g., about 25 degrees), and the central axis 105 of the beam is generally parallel with the front-to-back axis 109 of the cleaner (i.e., the yaw angle A is about zero degrees). Further, the beam is angled downward at a pitch angle B of about 15 to 25 degrees (e.g., about 20 degrees). As thus configured and arranged, the regions of light 77R projected onto the floor by the sensor-responsive LED devices 77 are located on opposite sides of the central area 121 illuminated by the illumination LED devices 75 (see FIG. 8). As noted previously, the sensor-responsive LED devices 77 and illumination LED devices 75 emit light of different colors so that it will be readily apparent to the user of the vacuum cleaner that a condition has been sensed by the condition sensing system. The side regions 77R may be entirely separate from the central area, or they may partially overlap the central area (as shown in FIG. 8), or they may completely overlap the central area. Because different colors are used, even a complete overlap will produce a different color at the overlap to signal a condition sensed by the sensing system. It will also be understood that the area or areas illuminated by the sensor-responsive LED devices 77 may be at locations other than as shown in FIG. 8. For example, the regions illuminated by the sensor-responsive LED devices 77 may be at only one side of the central area 121, or in front of the central area 121, or behind the central area 121. The only criterion is that the illuminated region or regions 77R be on the floor and readily visible to the user of the cleaner. In this regard, each region of light 77R illuminated by a sensor-responsive LED device 77 may have front-to-back dimension 145 (FIG. 8) in the range of about four to five in. and a side-to-side dimension 147 in the range of about 1.5 to 2.5 in.

FIG. 12 illustrates an exemplary electrical circuit for the sensing system 5, the sensor responsive light system 7, and the illumination system 9. In this particular configuration, the sensor responsive LED devices 77 are deactivated when the handle 51 of the vacuum cleaner is in an upright position and/or when the agitator 41 is off. Other circuits are possible.

In operation, the vacuum cleaner 1 is used to remove dirt from a floor. As the cleaner is pushed across the floor, the agitator 41 sweeps dirt up into the cleaner where it is suctioned along the flow path 45 toward a dirt collector on the cleaner. The passage of dirt along the flow passage 45 is sensed by the dirt sensor 65, which sends a signal to illuminate the sensor-responsive LED devices 75. The beams emitted by these devices 77 illuminate regions 77R on the floor which are readily visible to the user to indicate the presence of dirt being suctioned from the floor. If the vacuum cleaner is equipped with an illumination system 9, as described above, the region or regions 77R illuminated by the sensor-responsive beam(s) are preferably of a different color so that they are readily distinguishable from the regions 75R illuminated by the illumination beams. When the amount of dirt in the air moving along the flow path 45 decreases to a threshold level at which the sensor 65 no longer detects dirt, the sensor sends a signal to turn off the sensor-responsive LED devices 77, indicating to the operator that the particular floor area being vacuumed is clean.

As noted previously, the sensing system 5 described above may be used to sense conditions other than dirt on the floor. Regardless of the condition being sensed, the sensor-responsive LED devices 77 function in the same manner, that is, to illuminate one or more regions 77R on the floor to clearly indicate to the user the presence or absence of the condition being sensed.

Figure 13:
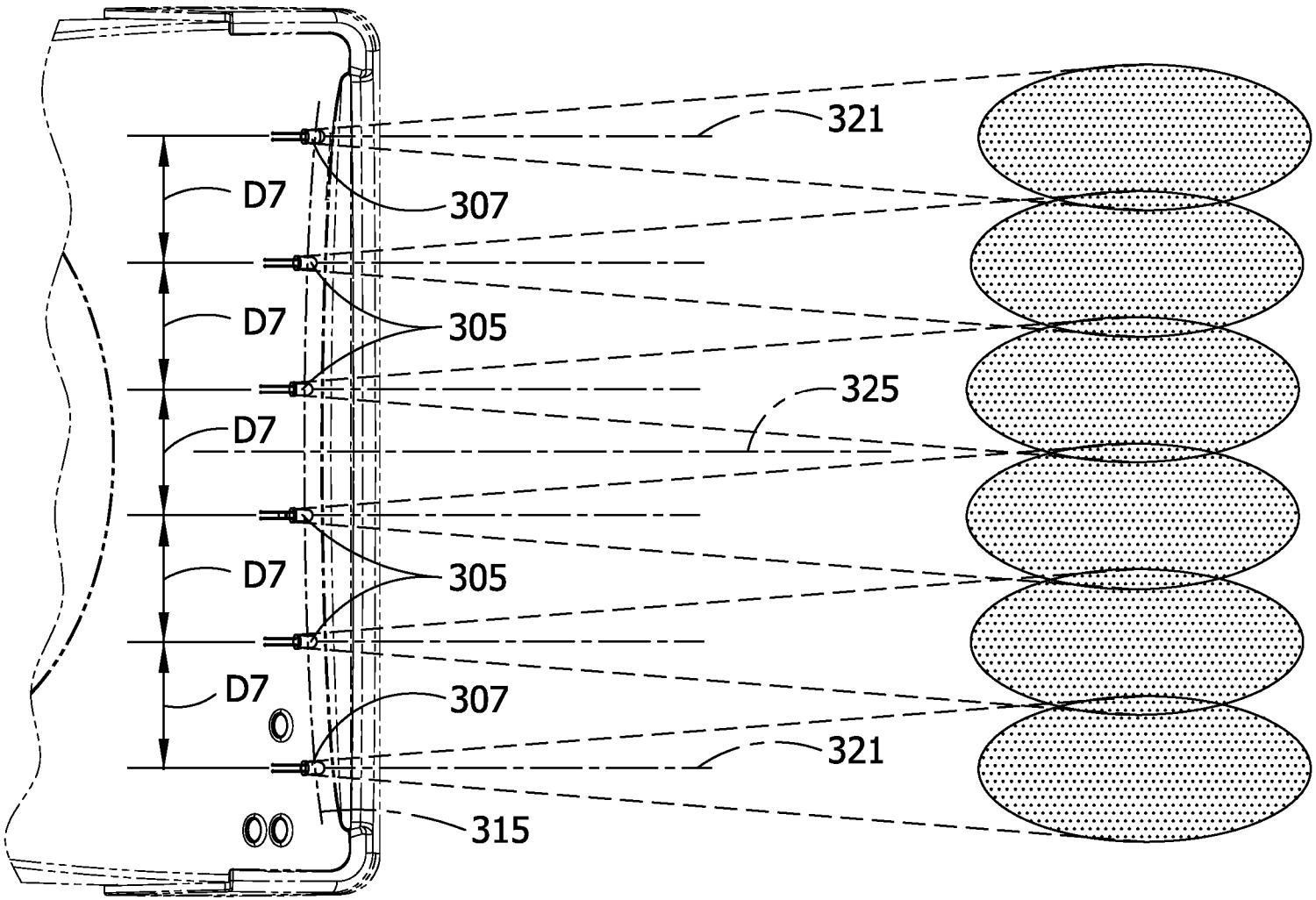
FIG. 13 is a top plan schematic view of a second embodiment of the cleaner showing a different array of LED devices on the cleaner.

FIG. 13 shows a second embodiment of a vacuum cleaner of this invention, generally designated 301. This embodiment is similar to the first embodiment except that the four illumination LED devices 305 and two sensor-responsive LED devices 307 are spaced at equal intervals D7 along an axis 315 extending generally transversely (side-to-side) with respect to the vacuum cleaner. Further, the central axes 321 of the light beams emitted by the LED devices 305, 307 are all generally parallel to the central front-to-back axis 325 of the cleaner. The pitch angles of the LED devices 305, 307 may be as described in the previous embodiment. The spacing (e.g., D7) between the LED devices 305, 307 is desirably such that the beams as projected onto the floor overlap to some extent. As in the previous embodiment, the color of light emitted by the two sensor-responsive LED devices 307 is preferably different from the color of light emitted by the illumination LED devices 305. The LED devices 305, 307 may be arranged in other ways without departing from the scope of this invention.

It will be understood that the specific arrangements, dimensions and configurations described above are exemplary only. The illumination system 9 may use illumination devices other than LED devices 75 (e.g., incandescent lamps), and the arrangement and configuration of such devices may vary. Further, the illumination system 9 may be eliminated entirely without departing from the scope of this invention. Similarly, the sensing system 5 may take other forms, and the sensor-responsive light system 7 may be configured differently without departing from the scope of this invention.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above constructions without departing from the scope of the invention, it is intended that all matter contained in the above description and shown in the accompanying drawing[s] shall be interpreted as illustrative and not in a limiting sense.

What is claimed is:

1. A vacuum cleaner comprising:

a suction head configured to draw air from a surface as the suction head is moved over a working area of the surface, a sensing system for sensing a presence of dirt in the air drawn from the surface by the suction head, and a sensor-responsive light system on the suction head and positioned to project light away from the suction head and onto a first region of the working area forward of the suction head based on the presence of dirt in the air drawn by the suction head.

2. A vacuum cleaner as set forth in claim 1 wherein the sensor-responsive light system projects the light in a generally forward direction onto the surface.

3. A vacuum cleaner as set forth in claim 1 further comprising an illumination system on the suction head for projecting light away from the suction head and onto a second region of the working area of the surface.

4. A vacuum cleaner as set forth in claim 3, wherein the light that is projected onto the first region of the working area by the sensor-responsive light system is of a first color, the light that is projected onto the second region of the working area by the illumination system is a second color, different from the first color.

5. A vacuum cleaner as set forth in claim 1 further comprising an illumination system for projecting light onto a second region of the working area, wherein the sensor-responsive light system is disposed outboard of the illumination system such that the first and second regions of the working area at least partially overlap one another.

6. A vacuum cleaner as set forth in claim 1 further comprising a handle pivotally coupled with the suction head, wherein the sensor-responsive light system is deactivated when the handle is in an upright position.

7. A vacuum cleaner comprising:

a suction head movable by a user of the vacuum cleaner over a working area of a surface to suction air from the surface, an illumination system for projecting light onto a first region of the working area to illuminate the working area, a dirt sensing system for sensing a presence of dirt in the air drawn from the surface by the suction head, and a sensor-responsive light system for projecting light onto a second region of the working area based on the presence of dirt sensed by the dirt sensing system, wherein the first and second regions at least partially overlap one another on the working area.

8. A vacuum cleaner as set forth in claim 7 wherein the light from said sensor-responsive light system is projected onto the working area at a location visible by the user of the vacuum cleaner.

9. A vacuum cleaner as set forth in claim 7 further comprising a handle pivotally coupled with the suction head, wherein the sensor-responsive light system is deactivated when the handle is in an upright position with respect to the surface.

10. A vacuum cleaner as set forth in claim 1 further comprising an illumination system configured to project light onto a second region of the working area, the sensor-responsive light system projecting the light on opposing sides of the second region of the working area.

11. A vacuum cleaner as set forth in claim 1 wherein the sensor-responsive light system comprises at least one light mounted to the suction head and positioned to project a beam of the light onto the first region of the working area in a downward direction forward of the suction head.

12. A vacuum cleaner as set forth in claim 1 wherein the sensing system senses a characteristic of airflow through a filter, further wherein the sensor-responsive light system projects light onto the working area based on the characteristic of airflow.

13. A vacuum cleaner as set forth in claim 1 wherein the sensing system senses a level of dirt in a dirt collector, further wherein the sensor-responsive light system projects light onto the working area based on the level of dirt.

14. A vacuum cleaner as set forth in claim 7 wherein the dirt sensing system senses a characteristic of airflow through a filter, further wherein the sensor-responsive light system projects light onto the second region based on the characteristic of airflow.

15. A vacuum cleaner as set forth in claim 7 wherein the dirt sensing system senses a level of dirt in a dirt collector, further wherein the sensor-responsive light system projects light onto the second region based on the level of dirt.

16. A vacuum cleaner as set forth in claim 7 wherein the sensor-responsive light system projects the light on the second region and a third region of the working area, the second and third regions disposed on opposite sides of the first region of the working area.

17. A vacuum cleaner as set forth in claim 4, wherein the first and second regions at least partially overlap one another on the working area to mix the first and second colors and create a third color in the working area where the first and second regions overlap.

18. A vacuum cleaner as set forth in claim 1, wherein the sensor-responsive light system is deactivated when an amount of dirt sensed by the sensing system decreases to a threshold level.

19. A vacuum cleaner as set forth in claim 7, wherein the light projected by the illumination system is a color that differs from the light projected by the sensor-responsive light system such that the colors of the lights projected by the illumination system and the sensor-responsive light system mix to create a third color on the working area where the first and second regions overlap.

20. A vacuum cleaner as set forth in claim 7, wherein the sensor-responsive light system is deactivated when an amount of dirt sensed by the sensing system decreases to a threshold level.

* * * * *

UNITED STATES PATENT AND TRADEMARK OFFICE

CERTIFICATE OF CORRECTION

PATENT NO. : 7,627,927 B2
APPLICATION NO. : 11/760077
DATED : December 8, 2009
INVENTOR(S) : Douglas Blocker, John F. Kaido and T. Joy H. Petty It is certified that error appears in the above-identified patent and that said Letters Patent is hereby corrected as shown below:

Claims 10-13 should be renumbered as claims 7-10, claims 17-18 should be renumbered as claims 11-12, claims 7-9 should be renumbered as claims 13-15, and claims 14-16 should be renumbered as claims 16-18

Signed and Sealed this

Ninth Day of March, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,627,927 B2
APPLICATION NO. : 11/760077
DATED : December 8, 2009
INVENTOR(S) : Douglas Blocker et al.

It is certified that error appears in the above-identified patent and that said Letters Patent is hereby corrected as shown below:

Column 7, line 38; claim 8 in originally issued patent, renumbered claim 14 in the Certificate of Correction dated March 9, 2010: Replace "A vacuum cleaner as set forth in claim 7" with "A vacuum cleaner as set forth in claim 13"

Column 7, line 42; claim 9 in originally issued patent, renumbered claim 15 in the Certificate of Correction dated March 9, 2010: Replace "A vacuum cleaner as set forth in claim 7" with "A vacuum cleaner as set forth in claim 13"

Column 8, line 15; claim 14 in originally issued patent, renumbered claim 16 in the Certificate of Correction dated March 9, 2010: Replace "A vacuum cleaner as set forth in claim 7" with "A vacuum cleaner as set forth in claim 13"

Column 8, line 20; claim 15 in originally issued patent, renumbered claim 17 in the Certificate of Correction dated March 9, 2010: Replace "A vacuum cleaner as set forth in claim 7" with "A vacuum cleaner as set forth in claim 13"

Column 8, line 24; claim 16 in originally issued patent, renumbered claim 18 in the Certificate of Correction dated March 9, 2010: Replace "A vacuum cleaner as set forth in claim 7" with "A vacuum cleaner as set forth in claim 13"

Column 8, line 39; claim 19: Replace "A vacuum cleaner as set forth in claim 7" with "A vacuum cleaner as set forth in claim 13"

Column 8, line 46; claim 20: Replace "A vacuum cleaner as set forth in claim 7" with "A vacuum cleaner as set forth in claim 13"

Signed and Sealed this

Twenty-second Day of June, 2010

David J. Kappos

David J. Kappos
*Director of the United States Patent and Trademark Office*